US011454008B2

(12) United States Patent
Gray et al.

(10) Patent No.: US 11,454,008 B2
(45) Date of Patent: Sep. 27, 2022

(54) MONITORING SYSTEM FOR A GRADING MACHINE

(71) Applicant: Caterpillar Inc., Deerfield, IL (US)

(72) Inventors: Eric M. Gray, Mt Zion, IL (US); Patrick Bishop, Heyworth, IL (US)

(73) Assignee: Caterpillar Inc., Peoria, IL (US)

( * ) Notice: Subject to any disclaimer, the term of this patent is extended or adjusted under 35 U.S.C. 154(b) by 473 days.

(21) Appl. No.: 16/539,402

(22) Filed: Aug. 13, 2019

(65) Prior Publication Data

US 2021/0047807 A1 Feb. 18, 2021

(51) Int. Cl.

| | |
|---|---|
| ***E02F 9/26*** | (2006.01) |
| ***G07C 5/08*** | (2006.01) |
| ***F15B 19/00*** | (2006.01) |
| ***G07C 5/06*** | (2006.01) |
| ***G07C 5/00*** | (2006.01) |

(52) U.S. Cl.

CPC ..... *E02F 9/267* (2013.01); *E02F 9/264* (2013.01); *F15B 19/005* (2013.01); *G07C 5/006* (2013.01); *G07C 5/0808* (2013.01)

(58) Field of Classification Search

None

See application file for complete search history.

(56) References Cited

U.S. PATENT DOCUMENTS

| | | | | |
|---|---|---|---|---|
| 4,571,994 | A * | 2/1986 | Dickey | F15B 19/00 73/168 |
| 4,938,054 | A * | 7/1990 | Dye | G01B 17/00 73/1.21 |
| 7,120,523 | B2 | 10/2006 | Muller | |
| 9,243,381 | B2 | 1/2016 | Behmlander et al. | |
| 9,592,866 | B2 | 3/2017 | Hasselbusch et al. | |
| 2015/0008296 | A1* | 1/2015 | Longaphie | B65D 85/68 248/121 |
| 2020/0362542 | A1* | 11/2020 | Veasy | E02F 9/264 |

FOREIGN PATENT DOCUMENTS

| | | | | |
|---|---|---|---|---|
| DE | 102013220699 | A1 * | 4/2015 | B60R 16/0232 |

* cited by examiner

*Primary Examiner* — Abdhesh K Jha

(74) *Attorney, Agent, or Firm* — Bookoff McAndrews, PLLC

(57) ABSTRACT

A system for a grading machine includes a lift cylinder sensor to measure a position or movement of a lift cylinder, which is coupled to a drawbar. The drawbar is coupled to a circle. The circle is coupled a blade carrier assembly, and the blade carrier assembly is coupled to a blade. The system also includes a drawbar sensor to measure a position or movement of the drawbar, a circle sensor to measure a position or movement of the circle, a blade carrier assembly sensor to measure a position or movement of the blade carrier assembly, and a blade sensor to measure a position or movement of the blade. A controller receives information from the lift cylinder sensor and one or more of the aforementioned sensors and determines whether one or more wear components is in need of inspection, repair, or replacement.

20 Claims, 4 Drawing Sheets

MONITORING SYSTEM FOR A GRADING MACHINE

TECHNICAL FIELD

The present disclosure relates generally to a grading machine, and more particularly, to a monitoring system for a grading machine.

BACKGROUND

The present disclosure relates to mobile machines that are used in grading. Grading machines are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task. The blade is supported and positioned by various components, including a hydraulic cylinders, a drawbar, a circle, and a blade carrier assembly. The various components wear over time and require regular inspection to determine whether the components should be adjusted, serviced, or replaced. However, the inspections may be complex and/or time consuming and may not be performed as regularly as needed.

U.S. Pat. No. 7,120,523, issued to Muller on Oct. 10, 2006 ("the '523 patent"), describes a method for operating a hydraulic cylinder. The '523 patent provides for sensing a position of a rod of the hydraulic cylinder, generating a movement of the rod, and indicating a service requirement based on the movement. The rod sensing and positioning details of the '523 patent may allow an operator to be aware of one or more wear conditions within the hydraulic cylinder, but may not provide sufficient monitoring of various wear conditions on a system or portion of a machine coupled to the hydraulic cylinder.

The monitoring system for a grading machine of the present disclosure may solve one or more of the problems set forth above and/or other problems in the art. The scope of the current disclosure, however, is defined by the attached claims, and not by the ability to solve any specific problem.

SUMMARY

In one aspect, a system for a grading machine may include at least one lift cylinder sensor configured to measure a position or movement of a portion of at least one lift cylinder. The at least one lift cylinder may be coupled to a drawbar, and the drawbar may be coupled to a circle. The circle may be coupled a blade carrier assembly, and the blade carrier assembly may be coupled to a blade. The system may also include a drawbar sensor configured to measure a position or movement of the drawbar, a circle sensor configured to measure a position or movement of the circle, a blade carrier assembly sensor configured to measure a position or movement of the blade carrier assembly, a blade sensor configured to measure a position or movement of the blade, and a controller. The controller may be configured to receive information from the lift cylinder sensor and one or more of the drawbar sensor, the circle sensor, the blade carrier assembly sensor, and the blade sensor and determine whether one or more wear components is in need of inspection, repair, or replacement.

In another aspect, a method for analyzing wear on a grading machine may include receiving a wear analysis procedure initiation command, driving components of the grading machine through a wear measuring movement, measuring movement of the components during the wear measuring movement, determining wear data based on the measured movement of the components during the wear measuring movement, and providing a notification if the wear data exceeds a predetermined threshold.

In yet another aspect, a system for a grading machine may include a blade and a blade carrier assembly coupled to the blade. The blade may include a blade sensor configured to measure a position or a movement of the blade, and the blade carrier assembly may include a blade carrier assembly sensor configured to measure a position or movement of the blade carrier assembly. The system may also include a circle coupled to the blade carrier assembly and a drawbar coupled to the circle. The circle may include a circle sensor configured to measure a position or movement of the circle, and the drawbar may include a drawbar sensor configured to measure a position or movement of the drawbar. The system may also include at least one lift cylinder and at least one lift cylinder rod movable relative to the at least one lift cylinder. The at least one lift cylinder rod may be coupled to the drawbar, and at least one lift cylinder sensor may be configured to measure a position or a movement of at least one cylinder rod relative to the at least one lift cylinder. The system may also include a controller configured to receive information regarding the position or movement information from one or more of the blade sensor, the blade carrier assembly sensor, the circle sensor, the drawbar sensor, and the at least one lift cylinder sensor to determine whether the position or movement of one or more components is outside of an acceptable range and identify wear in a wear component based on the received position or movement information.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces or earthen materials that may be worked in construction procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in a stated value. Although the current disclosure is described with reference to a motor grader, this is only exemplary. In general, the current disclosure can be applied as to any machine, such as, for example, a plow, scraper, dozer, or another grading-type machine.

Figure 1:
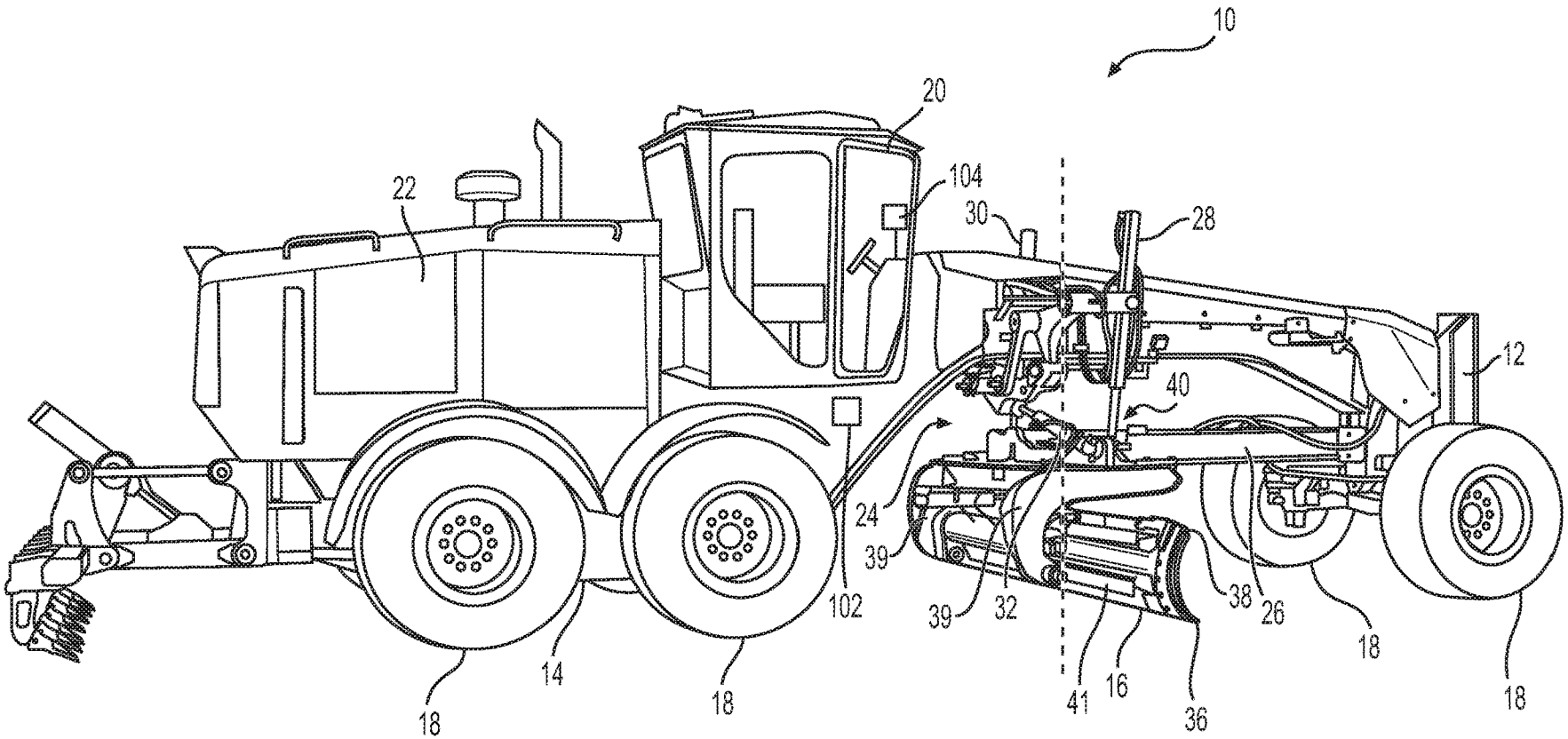
FIG. 1 is an illustration of an exemplary grading machine, according to aspects of this disclosure.
Figure 2:
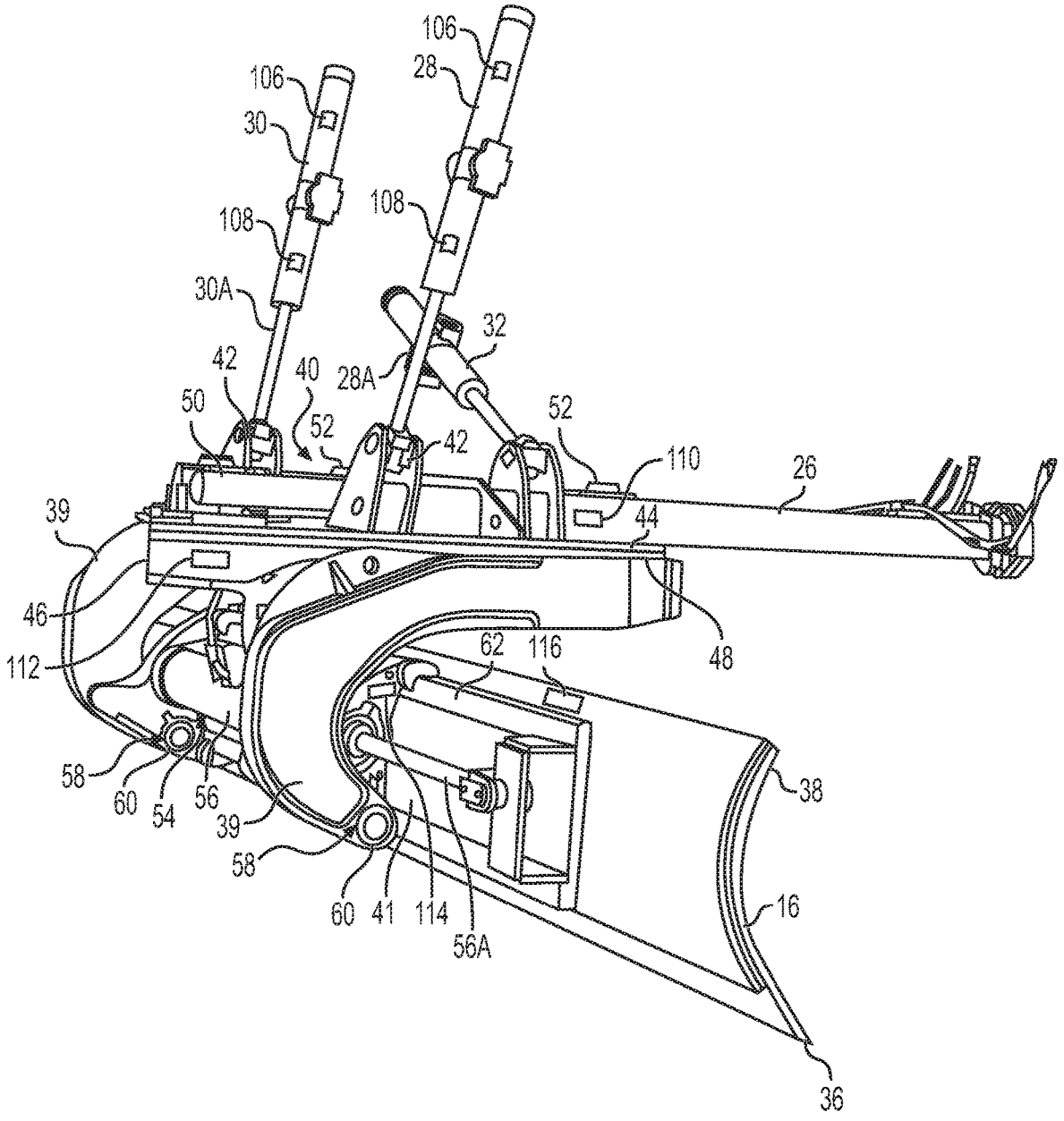
FIG. 2 is a perspective view of a grading portion of the grading machine of FIG. 1.

FIG. 1 illustrates a perspective view of an exemplary motor grader machine 10 (hereinafter "machine"), according to the present disclosure. Machine 10 includes a front frame 12, a rear frame 14, and a blade 16. Front frame 12 and rear frame 14 are supported by wheels 18. An operator cab 20 may be mounted above a coupling of front frame 12 and rear frame 14, and may include various controls, display units, touch screens, or user interfaces, for example, user interface 104, to operate or monitor the status of machine 10. Rear frame 14 also includes an engine 22 to drive or power machine 10. Blade 16, sometimes referred to as a moldboard, is used to cut, spread, or level (collectively "sculpt") the ground surface traversed by machine 10. As shown in greater detail in FIG. 2, blade 16 is mounted on a linkage assembly, shown generally at 24. Linkage assembly 24 allows blade 16 to be moved to a variety of different positions and orientations relative to machine 10, and thus sculpt the traversed material in different ways. Additionally, a circle drive system 40 may include or be coupled to a motor (e.g., a circle drive motor 50), and circle drive system 40 may include a gearing arrangement (e.g., a gear box 52) in order to engage with and rotate a circle 46 (FIG. 2) in order to adjust at least one aspect of blade 16. In one aspect, and as shown in FIG. 2, circle drive system 40 may include two circle drive motors 50 and two gear boxes 52, though it is noted that one circle drive motor 50 is blocked by drawbar 26 in FIG. 2.

Additionally, a controller 102 may be in communication with one or more features of machine 10 and receive inputs from and send outputs to, for example, user interface 104 in cab 20 or an interface remote from machine 10. In one aspect, machine 10 may be an electrohydraulic motor grader, and controller 102 may control one or more electrical switches or valves in order to control one or more hydraulic cylinders or electrical elements in order to operate machine 10. Moreover, as discussed below with respect to FIGS. 2-4, a plurality of sensors may be in communication with controller 102.

Starting at the front of the machine 10 and working rearward toward the blade 16, linkage assembly 24 includes a drawbar 26. Drawbar 26 is pivotably mounted to the front frame 12 with a ball joint (not shown). The position of drawbar 26 may be controlled by hydraulic cylinders, including, for example, a right lift cylinder 28, a left lift cylinder 30, a centershift cylinder 32, and a linkbar (not shown). A height of blade 16 with respect to the surface being traversed below machine 10, commonly referred to as blade height, may be primarily controlled and/or adjusted with the position of right lift rod 28A relative to right lift cylinder 28 and the position of left lift rod 30A relative to left lift cylinder 30. Right lift rod 28A and left lift rod 30A may be coupled to drawbar 26 via respective ball studs 42.

The position of right lift rod 28A relative to right lift cylinder 28 and the position of left lift rod 30A relative to left lift cylinder 30 may be controlled independently and, thus, may be used to tilt a bottom of blade 16, which includes a bottom cutting edge 36 and a top edge 38. The positions of right lift rod 28A and left lift rod 30A may also be used (e.g., extended or retracted simultaneously) to control the height of blade 16 relative to machine 10 in order to control the engagement of blade 16 with the ground surface, and thus the depth of the cut into the ground surface or a height of blade 16 above the ground surface.

The extension and/or retraction of right lift rod 28A and left lift rod 30A relative to right lift cylinder 28 and left lift cylinder 30 may be controlled by one or more lift cylinder actuator(s) 106. Lift cylinder actuator 106 may control the flow and/or pressure of hydraulic fluid to control the extension and/or retraction of right lift rod 28A and left lift rod 30A. Additionally, the extension and/or retraction of right lift rod 28A and left lift rod 30A may be monitored and/or measured by one or more lift cylinder sensor(s) 108. In one example, lift cylinder actuator 106 may control the extension and/or retraction of both right lift rod 28A and left lift rod 30A. In another example, one lift cylinder actuator 106 may control the extension and/or retraction of right lift rod 28A, and one lift cylinder actuator 106 may control the extension and/or retraction of left lift rod 30A. Furthermore, in one example, one lift cylinder sensor 108 may monitor and/or measure the extension and/or retraction (e.g., the movement and/or the position) of right lift rod 28A, and one lift cylinder sensor 108 may monitor and/or measure the extension and/or retraction (e.g., the movement and/or the position) of left lift rod 30A.

Centershift cylinder 32 may be used primarily to shift a lateral position of drawbar 26, and any components mounted to drawbar 26, relative to front frame 12. This lateral shifting is commonly referred to as drawbar centershift. Centershift cylinder 32 may include one end coupled to drawbar 26, and another end pivotably coupled to a linkbar (not shown). Although not shown, the linkbar may include a plurality of position holes for selectively positioning centershift cylinder 32 to the left or to the right to allow for further shifting of drawbar 26 to a left or to a right side of the machine 10 by centershift cylinder 32.

As shown in FIG. 2, drawbar 26 is coupled to a large, flat plate, commonly referred to as a yoke plate 44. Beneath yoke plate 44 is a large gear, commonly referred to as circle 46. Although not shown, circle 46 may include a plurality of teeth that extend along an inner portion of circle 46. Circle 46 may be rotated by circle drive system 40, which may include circle drive motor(s) 50 (e.g., a hydraulic motor) and one or more gear boxes 52, in order to rotate blade 16. The rotation of circle 46 by circle drive system 40, commonly referred to as circle angle, pivots blade 16 about an axis A (FIG. 1) fixed to drawbar 24 to establish a blade cutting angle.

One or more circle wear strips 48 may be positioned between yoke plate 44 and circle 46 in order to help reduce and/or prevent wear on yoke plate 44 and circle 46 as circle 46 is rotated relative to yoke plate 44. A drawbar sensor 110 may be coupled to drawbar 26 and/or to yoke plate 44 and may measure and/or monitor a movement and/or a position of drawbar 26 relative to the ground surface, relative to frame 12, and/or relative to another portion of machine 10. Additionally, a circle sensor 112 may be coupled to circle 46 and may measure and/or monitor a movement and/or a position of circle 46 relative to drawbar 26, relative to the ground surface, relative to frame 12, and/or relative to another portion of machine 10.

Circle 46 and blade 16 may be coupled via a blade carrier group or a blade carrier assembly 54. For example, one or more support arms 39 may extend from circle 46. Blade carrier assembly 54 may be coupled to support arms 39 via one or more pivot pin couplings 58, which may include respective pivot pin bushings 60 to help reduce and/or prevent wear on one or more pivot pins in pivot pin couplings 58 and/or on arms 39. Blade carrier assembly 54 may then be coupled to a support plate 41. A blade carrier assembly sensor 114 may be coupled to a portion of blade carrier assembly 54 in order to measure and/or monitor a movement and/or position of at least a portion of blade carrier assembly 54.

Additionally, a blade wear strip 62 may be positioned between blade 16 and one or more components of blade carrier assembly 54 or support plate 41. Blade wear strip 62 may help reduce and/or prevent wear on blade 16 and/or on blade carrier assembly 54 or support plate 41. Moreover, a blade sensor 116 may be coupled to a portion of blade 16 in order to measure and/or monitor a movement and/or position of at least a portion of blade 16.

Blade 16 may be mounted to drawbar 26 and/or circle 46 via a sliding joint. For example, a sideshift cylinder 56 and sideshift rod 56A may control the position of blade 16 relative to drawbar 26 and/or circle 46. Sideshift cylinder 56 may be positioned between support arms 39, and support rod 56A may be coupled to support plate 41. Thus, driving sideshift rod 56A relative to sideshift cylinder 56 slides or shifts blade 16 from side to side relative to drawbar 26 and circle 46. This side to side shift is commonly referred to as blade sideshift. Sideshift cylinder 56 may be may be coupled to blade carrier assembly 54, for example, to support arms 39.

Figure 3:
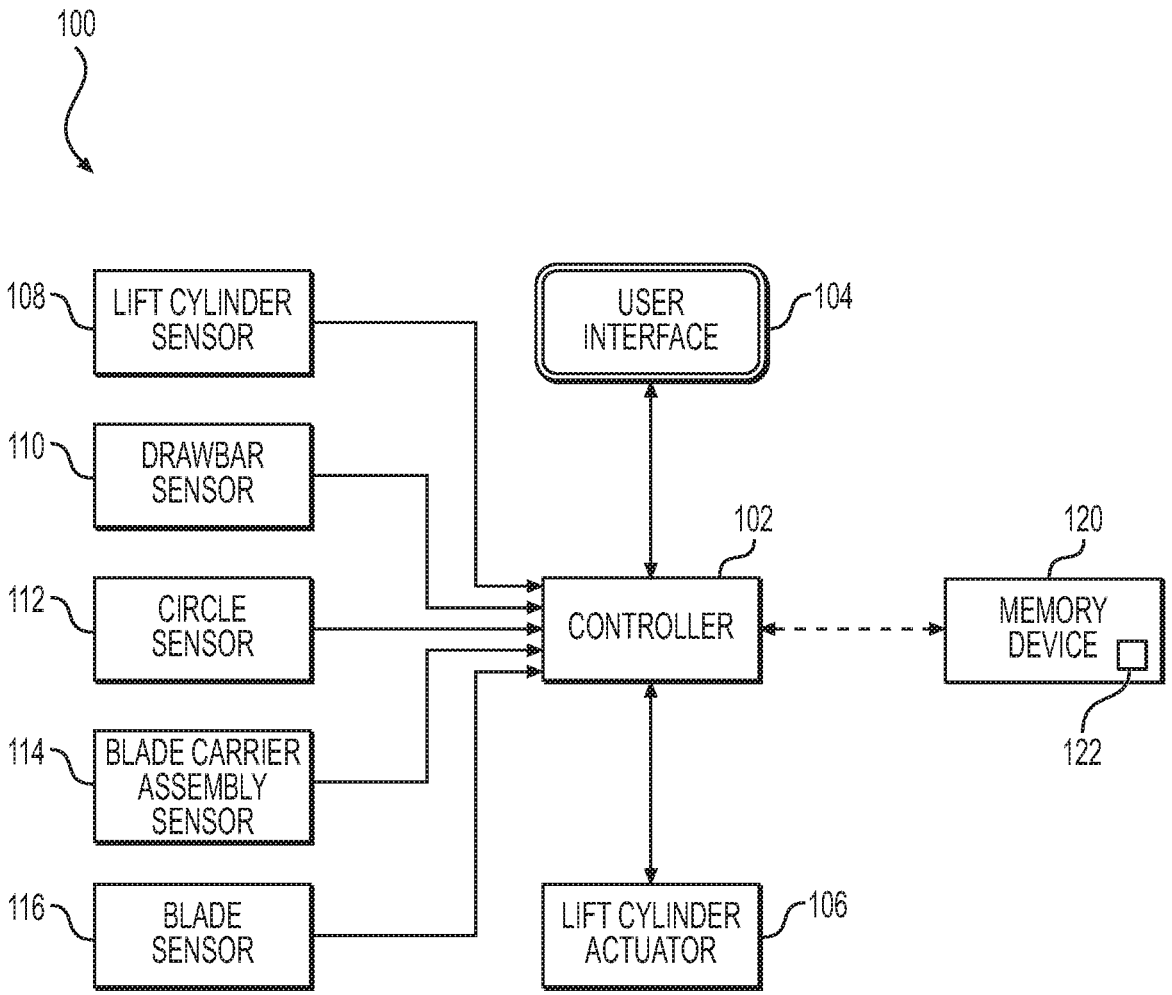
FIG. 3 is a schematic view of a portion of a monitoring system for the exemplary grading machine of FIG. 1.
Figure 4:
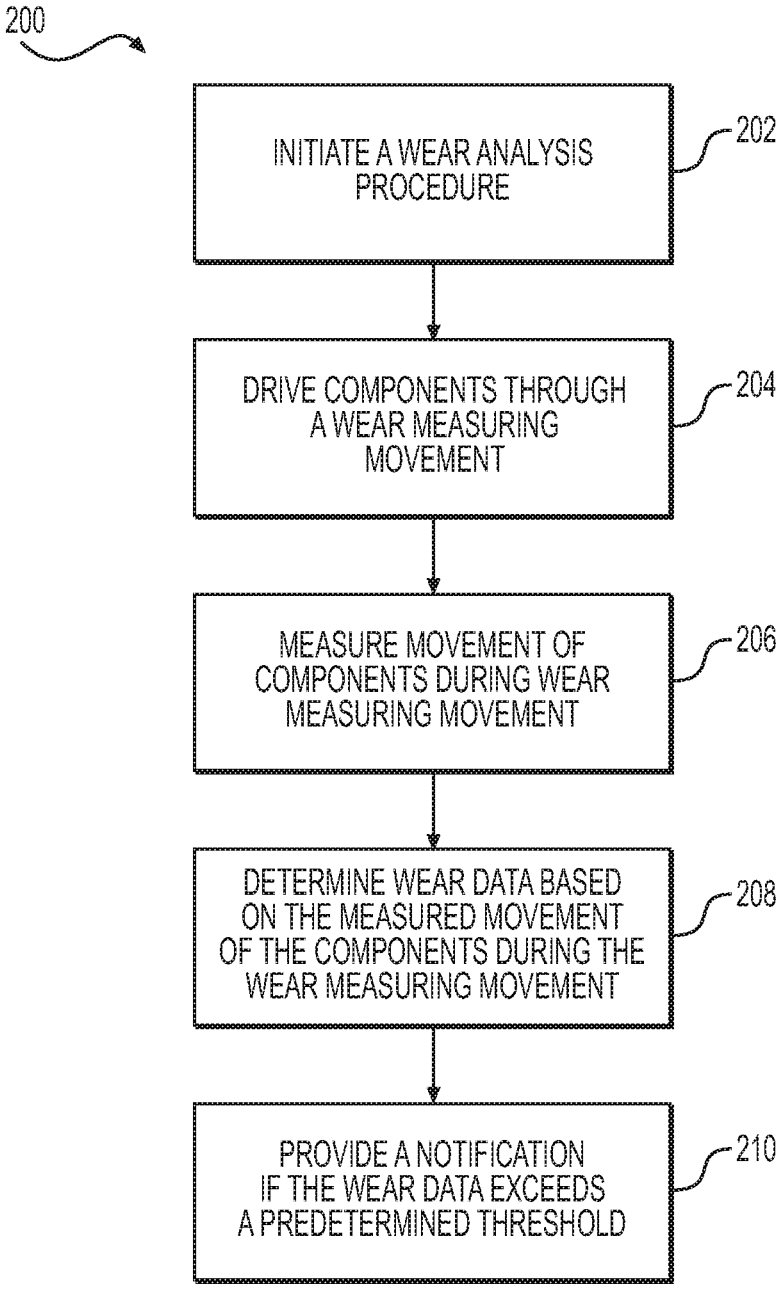
FIG. 4 provides a flow chart depicting an exemplary method for monitoring wear on portions of the blade positioning system of a grading machine.

FIG. 3 illustrates a schematic view of a monitoring system 100. As shown in FIGS. 2 and 3, system 100 may include controller 102, user interface 104, and a number of sensors and/or actuators. For example, system 100 may include one or more lift cylinder sensor(s) 108, drawbar sensor 110, circle sensor 112, blade carrier assembly sensor 114, and blade sensor 116. System 100 may include one or more lift cylinder actuator(s) 106. Furthermore, as shown in FIG. 3, controller 102 may be connected (e.g., wired or wirelessly) to a memory device 120. As discussed below, FIG. 4 illustrates an exemplary method 200 that may be performed by control system 100 to measure and/or monitor the position of various components of machine 10.

Controller 102 may be a separate controller on machine 10 or may be integrated into a central machine controller (e.g., a main motor grader control module). Alternatively, controller 102 may be integrated into a blade controller, an engine control module, or another dedicated control module on machine 10. Controller 102 may be in communication with and receive signals from a display and/or input device, for example, user interface 104, in order to receive operator input, display sensed information, signal alerts or notifications, etc. Controller 102 may also be in communication with circle drive system 40, for example, in order to adjust an angle, position, etc. of circle 46 and blade 16.

Controller 102 may embody a single microprocessor or multiple microprocessors that may include means for performing any of the operations mentioned herein. For example, controller 102 may include a memory, a secondary storage device, a processor, such as a central processing unit or any other means for accomplishing a task consistent with the present disclosure. The memory or secondary storage device associated with controller 102 may store data and/or software routines that may assist controller 102 in performing its functions. Further, the memory or secondary storage device associated with controller 102 may also store data received from the various sensors associated with machine 10. Numerous commercially available microprocessors can be configured to perform the functions of controller 102. It should be appreciated that controller 102 could readily embody a general machine controller capable of controlling numerous other machine functions. Various other known circuits may be associated with controller 102, including signal-conditioning circuitry, communication circuitry, hydraulic or other actuation circuitry, and other appropriate circuitry.

Controller 102 receives information from one or more of lift cylinder sensors 108, drawbar sensor 110, circle sensor 112, blade carrier assembly sensor 114, and blade sensor 116. As discussed above, each of lift cylinder sensors 108, drawbar sensor 110, circle sensor 112, blade carrier assembly sensor 114, and blade sensor 116 may be coupled to respective components on machine 10 and measure and/or monitor movement and/or a position of the component relative to the ground, a portion of machine 10 (e.g., front frame 12), or relative to another component. For example, one or more of lift cylinder sensors 108, drawbar sensor 110, circle sensor 112, blade carrier assembly sensor 114, and blade sensor 116 may be inertial measurement units, proximity sensors (e.g., optical or laser sensors, sonic sensors, etc.), wireless node sensors (e.g., measure positions relative to a central device), pressure sensors (e.g., measure pressure of hydraulic fluid within a hydraulic cylinder), or any other appropriate sensors. In one aspect, lift cylinder sensors 108 may measure and/or monitor a position and/or movement of lift rods 28A, 30A relative to lift cylinders 28, 30 in order to determine an extension or retraction of lift rods 28A, 30A. Drawbar sensor 110 may measure and/or monitor a position and/or movement of drawbar 26 relative to front frame 12 and/or relative to the ground surface. Circle sensor 112 may measure and/or monitor a position and/or movement of circle 46 relative to front frame 12 and/or relative to drawbar 26 or yoke plate 44. Alternatively or additionally, circle sensor 112 may measure and/or monitor a position and/or movement of circle 46 relative to the ground surface. Blade carrier assembly sensor 114 may measure and/or monitor a movement and/or a position of one or more portions of blade carrier assembly 54 relative to circle 46 and/or relative to the ground surface. Blade sensor 116 may measure and/or monitor a movement and/or position of blade 16 relative to one or more portions of blade carrier assembly 54 and/or relative to the ground surface.

INDUSTRIAL APPLICABILITY

The disclosed aspects of machine 10 may be used in any grading or sculpting machine to assist in monitoring the positions of one or more of blade 16, drawbar 26, circle 46, blade carrier assembly 54, etc. Lift cylinder actuator(s) 106 may help an operator position drawbar 26, blade 16, and other components that support blade 16. Additionally, and as will be described in more detail below, controller 102 and method 200 may help measure and/or monitor the positions of drawbar 26, blade 16, and other components that support blade 16 in order to help determine whether one or more components has been worn down, and thus is in need of inspection, repair, replacement, etc.

FIG. 4 is a flow diagram portraying an exemplary method 200 that may be performed by control system 100 to monitor the positioning and/or movement of drawbar 26, blade 16, and other components supporting blade 16, as discussed above. Method 200 may be performed with machine 10 in a static or stationary position, or may be performed while machine 10 is in motion. Method 200 includes a step 202, in which a wear analysis procedure is initiated. For example, controller 102 may receive a wear analysis procedure initiation command. As mentioned above, the wear analysis procedure may be initiated at the start of a grading procedure, at the end of a grading procedure, or periodically through one or more grading procedures and/or the lifetime of machine 10. Alternatively, the initiation step may be operator initiated. Moreover, the initiation of the wear analysis procedure may be operator overridden. For example, at the start of a grading procedure, at the end of the grading procedure, or periodically through the lifetime of machine 10, a prompt may be displayed to the user (e.g., via user interface 104) to either initiate the wear analysis procedure or decline the wear analysis procedure. The user's selection may also be recorded by system 100 and/or transmitted to memory device 120. In one aspect, the option to decline the wear analysis procedure may only be selected if the user inputs a password (e.g., via user interface 104). Moreover, step 202 may be initiated by a work site manager, a supplier, or another third party remote from machine 10, for example, if machine 10 is an autonomous machine.

Next, a step 204 includes driving components of machine 10 through a wear measuring movement. The wear measuring movement may include positioning blade components in an extreme position, for example, a fully engaged, a fully extended, or fully retracted position. For example, step 204 may include lowering blade components to a fully engaged position such that blade 16 is fully engaged with the ground surface. Lowering the blade components to a fully engaged position may include lift cylinder controller 106 signaling right lift rod 28A to extend from right lift cylinder 28 and signaling left lift rod 30A to extend from left lift cylinder 30, such that drawbar 26 and the other components supporting blade 16 push blade 16 into the ground surface. Lift rods 28A, 30A may be fully extended, or may extended a distance such that blade 16 is fully engaged with the ground surface. In the extreme position, the blade components may be vertically pressed together in order to help minimize any vertical space, gaps, or slack between the blade components that may have formed due to wear or other conditions.

Then, the wear measuring movement of step 204 also includes moving the blade components from the extreme position, for example, by raising the lift cylinders. For example, after the blade components are fully engaged, step 204 may include lift cylinder controller 106 signaling right lift rod 28A to retract relative to right lift cylinder 28 and signaling left lift rod 30A to retract relative to left lift cylinder 30. The raising of the lift cylinders may be gradual, for example, slower than a normal blade positioning procedure.

A step 206 includes measuring the movement of one or more components during the wear measuring movement. For example, as the lift rods 28A, 30A are raised, drawbar 28, circle 46, blade carrier assembly 54, and blade 16 should also be raised at the same or similar speeds or rate as lift rods 28A, 30A. Similarly, as the lift rods 28A, 30A are raised a certain distance, drawbar 28, circle 46, blade carrier assembly 54, and blade 16 should also be raised the same or similar distances as lift rods 28A, 30A. Step 206 may include controller 102 receiving signals from one or more of lift cylinder sensors 108, drawbar sensor 110, circle sensor 112, blade carrier assembly sensor 114, and blade sensor 116 regarding the movement and/or position of the various components.

A step 208 includes determining wear data based on the measured movement of the components during the wear measuring movement. Step 208 may include determining whether the movement and/or position of the one or more components is within an acceptable range. For example, controller 102 may receive movement and/or position information from lift cylinder sensors 108 to determine a rate of movement and/or position for lift rods 28A, 30A. Controller 102 may also receive movement and/or position information from one or more of drawbar sensor 110, circle sensor 112, blade carrier assembly sensor 114, and blade sensor 116. The movement and/or position information from the various sensors may include whether the component is moving, the time and/or duration of any movement, the distance moved by the component, a pressure within a fluid line (e.g., a hydraulic fluid line) connected to the component or a pressure within the component (e.g., a hydraulic cylinder), etc. Controller 102 may compare the movement and/or position information from one or more of drawbar sensor 110, circle sensor 112, blade carrier assembly sensor 114, and blade sensor 116 to the movement and/or position information from lift cylinder sensors 108. In one aspect, controller 102 may determine whether the movement and/or position information from one or more of drawbar sensor 110, circle sensor 112, blade carrier assembly sensor 114, and blade sensor 116 aligns with the movement and/or position information from lift cylinder sensors 108. In another aspect, controller 102 may determine whether the movement and/or position information from one or more of drawbar sensor 110, circle sensor 112, blade carrier assembly sensor 114, and blade sensor 116 is within an acceptable range with the movement and/or position information from lift cylinder sensors 108.

Controller 102 or memory device 120 may include an acceptability table 122, which includes a listing of differences in the movement and/or position information for one or more of the various sensors. For example, based on the movement and/or position information from lift cylinder sensors 108, acceptability table 122 may include expected movement and/or position information for one or more of drawbar 28, circle 46, blade carrier assembly 54, and blade 16. The expected movement and/or position information may be relative to lift rods 28A, 30A, may be relative to an adjacent component, or may be relative to the ground surface. For example, the expected movement of circle 46 may be relative to lift rods 28A, 30A, or may be relative to drawbar 28. Acceptability table 122 may also include differences from the expected movement and/or position information. The differences may correspond to an increasing level of concern. For example, with respect to measuring the position information, acceptability table 122 may indicate that position information with values within approximately 50 millimeters of the expected position information may be acceptable. Acceptability table 122 may indicate that position information with values of approximately 60 millimeters from the expected position information may indicate moderate wear (e.g., approximately 10 millimeters of wear), which may correspond to a need to schedule inspection, repair, and/or replacement of one or more components in the future. Acceptability table 122 may indicate that position information with values of approximately 70 millimeters or more from the expected position information may indicate serious wear (e.g., approximately 20 millimeters or more of wear), which may indicate an immediate need for inspection, repair, and/or replacement of one or more components. Acceptability table 122 may include differing values for different components of machine 10. For example, the acceptable variance between yoke plate 44 and circle 46 (e.g., wear on circle wear strip 48) may be greater than the acceptable variance between lift rods 28A, 30A and drawbar 26 (e.g., wear on ball studs 42).

Next, a step 210 includes providing a notification if the wear data exceeds a predetermined threshold. For example, if the position and/or movement information for one or more components exceeds the acceptable values listed in acceptability table 122, the notification may be provided. For example, the results of the comparisons may be displayed to the user (e.g., via user interface 104) either as an alert if attention is required or as a report if no attention is required. The results may also be transmitted to third party, for example, a record keeper for a work site, a company, a supplier, a warranty provider, a manufacturer, etc. Step 210 may include providing a notification that no measured wear data exceeded the predetermined threshold. Moreover, the alerts and/or results may be stored on a memory device (e.g., memory device 120), which may be local on machine 10 or may be disconnected from machine 10.

Method 200 may help to determine the location of any wear on the components controlling blade 16. For example, in one aspect, the movement and/or position information from drawbar sensor 110, circle sensor 112, blade carrier assembly sensor 114 may be within the respective acceptable range, but the movement and/or position information from blade sensor 116 may be outside of the acceptable range. In such an instance, controller 102 may indicate to a user (e.g., via user interface 104) that blade wear strip 62 is in need of inspection, repair, and/or replacement. In another aspect, the movement and/or position information from drawbar sensor 110 and circle sensor 112 may be within the acceptable range, but the movement and/or position information from blade carrier assembly sensor 114 and blade sensor 116 may be outside of the acceptable range. In such an instance, controller 102 may indicate to a user that pivot pin bushing 60 is in need of inspection, repair, and/or replacement. Furthermore, the movement and/or position information from drawbar sensor 110 may be within the acceptable range, but the movement and/or position information from circle sensor 112, blade carrier assembly sensor 114, and blade sensor 116 may be outside of the acceptable range. In such an instance, controller 102 may indicate to a user that circle wear strip 48 is in need of inspection, repair, and/or replacement. Moreover, in yet another aspect, the movement and/or position information from drawbar sensor 110, circle sensor 112, blade carrier assembly sensor 114, and blade sensor 116 may all be outside of the acceptable range. In such an instance, controller 102 may indicate to a user that ball studs 42 are in need of inspection, repair, and/or replacement.

Alternatively, although not shown, step 204 may include lifting the blade components to a fully elevated position and then lowering the blade components instead of raising the blade components. Step 206 may include measuring the movement and/or position for the one or more components as the blade components are lowered. Step 208 may also include comparing the movement and/or position from the one or more sensors to the movement and/or position information from lift cylinder sensors 108.

As mentioned, method 200 may include an optional step of storing and/or transmitting the results of method 200. For example, controller 102 may transmit the results of method 200 to memory device 120 (e.g., an internal memory, an external server, a work site data storage device, etc.). In one aspect, controller 102 may transmit the results of method 200 to memory device 120 regardless of the results, e.g., such that memory device stores the fact that method 200 was performed. In another aspect, controller 102 may transmit the results of method 200 to memory device 120 only if step 210 determines that the movement for the one or more components is above the predetermined threshold and/or is not within an acceptable range. Furthermore, the optional step may include transmitting one or more signals regarding the performance and/or results of method 200 to a central storage unit, for example, a record keeper for a work site, a company, a supplier, a warranty provider, a manufacturer, etc. In this aspect, a supervisor, a supplier, or another entity may be advised as to the performance and/or the results of method 200, for example, to determine whether proper and timely maintenance and/or measurements were performed before a component of machine 10 malfunctions and/or is in need of replacement.

Controller 102 may perform method 200 during the initiation, during the end, and/or periodically or continuously during the entirety of grading procedure(s). For example, controller 102 may perform method 200 every 500 hours of grading, every 50 miles, every 30 days, etc. During method 200, controller 102 may measure and/or monitor various aspects of machine 10 to help prevent damage to various components of machine 10, for example, by detecting inconsistencies in the positioning and/or movement of drawbar 26, blade 16, and/or other components that support blade 16. By detecting inconsistencies in the positioning and/or movement of these components, controller 102 and method 200 may help determine whether the components should be inspected, repaired, replaced, etc.

For example, during grading operations and over time, one or more of ball studs 42, circle wear strip 48, pivot pin bushings 60, and blade wear strip 62 may wear down due to friction between components, erosion, impacts imparted from the ground surface, debris, etc. Wear on one or more of these components may affect the positioning of blade 16 and the other components of machine 10. Additionally, these components may be inspected in order to detect the wear, but visual inspection may be difficult, dangerous, time-consuming, often not performed, etc. Failure to inspect these components for wear and/or failure to replace worn components may lead to the malfunction of the components and/or other portions of machine 10, which may require expensive and/or time-consuming repairs.

Furthermore, one or more additional sensors may be positioned on one or more additional components controlling blade 16. For example, one or more sensors may be positioned on circle drive motor 50, gear box 52, etc., and the information from the sensors may be compared to a rotational position sensor on circle 46 and/or blade 16 in order to measure and/or monitor a rotational position of circle 46 and/or blade 16. In this aspect, sensors may be positioned on one or more of circle drive motor 50, gear box 52, circle 46, and/or blade 16 to measure the movement and/or angular position of each component. Information from the respective rotational positions may be used to determine whether one or more portions of the circle drive motor 50, gear box 52, teeth on circle 46, etc. are in need of inspection, repair, replacement, etc.

It will be apparent to those skilled in the art that various modifications and variations can be made to the disclosed machine without departing from the scope of the disclosure. Other embodiments of the machine will be apparent to those skilled in the art from consideration of the specification and practice of the monitoring system for a grading machine disclosed herein. It is intended that the specification and examples be considered as exemplary only, with a true scope of the disclosure being indicated by the following claims and their equivalents.

What is claimed is:

1. A system for a grading machine, comprising:

at least one lift cylinder sensor configured to measure a position or movement of a portion of at least one lift cylinder, wherein the at least one lift cylinder is coupled to a drawbar, wherein the drawbar is coupled to a circle, wherein the circle is coupled to a blade carrier assembly, and wherein the blade carrier assembly is coupled to a blade;

a drawbar sensor configured to measure a position or movement of the drawbar;

a circle sensor configured to measure a position or movement of the circle;

a blade carrier assembly sensor configured to measure a position or movement of the blade carrier assembly;

a blade sensor configured to measure a position or movement of the blade; and a controller, wherein the controller is configured to drive the at least one lift cylinder through a wear measuring movement, wherein the controller is configured to receive information regarding the wear measuring movement from the lift cylinder sensor and one or more of the drawbar sensor, the circle sensor, the blade carrier assembly sensor, or the blade sensor during the wear measuring movement and determine whether one or more wear components is in need of inspection, repair, or replacement.

2. The system of claim 1, further including a lift cylinder actuator in communication with the controller, wherein the lift cylinder actuator is configured to extend at least one cylinder rod relative to the respective at least one lift cylinder in response to a signal to initiate a wear analysis procedure.

3. The system of claim 2, wherein the lift cylinder actuator is configured to retract the at least one cylinder rod relative to the respective at least one lift cylinder in order to perform the wear analysis procedure.

4. The system of claim 3, wherein the drawbar sensor, the circle sensor, the blade carrier assembly sensor, and the blade sensor are configured to measure or monitor the movement or position of the respective component during the wear analysis procedure.

5. The system of claim 4, wherein the controller is configured to compare movement or position information, regarding the wear measuring movement, from at least one of the drawbar sensor, the circle sensor, the blade carrier assembly sensor, or the blade sensor to an acceptability table.

6. The system of claim 5, further including a user interface, and wherein, upon the controller determining that the movement or position information, regarding the wear measuring movement, from at least one of the drawbar sensor, the circle sensor, the blade carrier assembly sensor, or the blade sensor is outside of an acceptable range of the acceptability table, the controller is configured to transmit an alert to the user interface.

7. The system of claim 1, wherein at least one of the drawbar sensor, the circle sensor, the blade carrier assembly sensor, or the blade sensor is an inertial measurement unit, a proximity sensor, or a wireless node sensor.

8. The system of claim 1, further including a memory device in communication with the controller.

9. The system of claim 8, wherein, upon the controller determining that movement or position information, regarding the wear measuring movement, from at least one of the drawbar sensor, the circle sensor, the blade carrier assembly sensor, or the blade sensor is outside of an acceptable range, the controller is configured to transmit details of the movement or position information, regarding the wear measuring movement, for the respective sensor to the memory device.

10. The system of claim 1, wherein the wear components include:

one or more ball studs between the at least one lift cylinder and the drawbar;

a circle wear strip between the drawbar and the circle;

a pivot pin bushing between the circle and the blade carrier assembly; and a blade wear strip between the blade carrier assembly and the blade.

11. A method for analyzing wear on a grading machine, comprising:

receiving a wear analysis procedure initiation command;

driving components of the grading machine through a wear measuring movement;

measuring movement of the components during the wear measuring movement;

determining wear data based on the measured movement of the components during the wear measuring movement; and providing a notification if the wear data exceeds a predetermined threshold.

12. The method of claim 11, wherein the wear analysis procedure initiation command is received at a start or at an end of each grading procedure.

13. The method of claim 11, wherein the wear analysis procedure initiation command is received periodically during a grading lifetime of the grading machine.

14. The method of claim 11, wherein driving the components of the grading machine through the wear measuring movement includes positioning blade support components and a blade in an extreme position, wherein the blade support components include one or more lift rods, a drawbar, a circle, or a blade carrier assembly, and wherein measuring movements or positions of at least one of the blade support components or the blade includes one or more inertial measurement units, proximity sensors, pressure sensors, or wireless node sensors.

15. The method of claim 14, wherein driving the components through the wear measuring movement includes extending the one or more lift rods until the blade is engaged in a ground surface, and wherein the wear data corresponds to wear data regarding one or more wear components, including one or more ball studs between the one or more lift rods and the drawbar, a circle wear strip between the drawbar and the circle, a pivot pin bushing between the circle and the blade carrier assembly, or a blade wear strip between the blade carrier assembly and the blade.

16. The method of claim 15, wherein determining the wear data based on the measured movement of the components during the wear measuring movement includes identifying at least one wear component of the wear components that is in need of inspection, repair, or replacement.

17. The method of claim 11, wherein providing the notification if the wear data exceeds the predetermined threshold includes comparing the measured movement of the components to values on an acceptability table, and wherein, upon determining that the wear data exceeds the values on the acceptability table, providing the notification includes transmitting movement or position information, regarding the wear measuring movement, to a user interface or to a memory device.

18. A system for a grading machine, comprising:

a blade, wherein the blade includes a blade sensor configured to measure a position or a movement of the blade;

a blade carrier assembly coupled to the blade, wherein the blade carrier assembly includes a blade carrier assembly sensor configured to measure a position or movement of the blade carrier assembly;

a circle coupled to the blade carrier assembly, wherein the circle includes a circle sensor configured to measure a position or movement of the circle;

a drawbar coupled to the circle, wherein the drawbar includes a drawbar sensor configured to measure a position or movement of the drawbar;

at least one lift cylinder and at least one lift cylinder rod, the at least one lift cylinder rod being movable relative to the at least one lift cylinder, wherein the at least one lift cylinder rod is coupled to the drawbar, and wherein at least one lift cylinder sensor is configured to measure a position or a movement of the at least one lift cylinder rod relative to the at least one lift cylinder; and a controller, wherein the controller is configured to drive the at least one lift cylinder rod through a wear measuring movement, wherein the controller is configured to receive position or movement information, regarding the wear measuring movement, from one or more of the blade sensor, the blade carrier assembly sensor, the circle sensor, the drawbar sensor, or the at least one lift cylinder sensor to determine whether the position or movement of one or more of the blade, the blade carrier assembly, the circle, the drawbar, or the at least one lift cylinder rod is outside of an acceptable range and identify wear in a wear component based on the received position or movement information, and wherein the controller is configured to determine wear data based on the measured movement of one or more of the blade, the blade carrier assembly, the circle, the drawbar, or the at least one lift cylinder rod during the wear measuring movement, wherein the wear data corresponds to wear of one or more of:

one or more ball studs between the at least one lift cylinder and the drawbar, a circle wear strip between the drawbar and the circle, a pivot pin bushing between the circle and the blade carrier assembly, or a blade wear strip between the blade carrier assembly and the blade.

19. The system of claim 18, wherein one or more of the blade sensor, the blade carrier assembly sensor, the circle sensor, the drawbar sensor, or the at least one lift cylinder sensor includes an inertial measurement unit, a proximity sensor, or a wireless node sensor configured to determine a distance moved by a respective component.

20. The system of claim 18, further including a user interface and a memory device, and wherein, upon the controller determining that the position or movement information from one or more of the blade sensor, the blade carrier assembly sensor, the circle sensor, the drawbar sensor, or the at least one lift cylinder sensor is outside of the acceptable range, the controller is configured to transmit a notification to the user interface and transmit the position or movement information to the memory device.

* * * * *